US008668503B2

(12) United States Patent
Williams et al.

(10) Patent No.: US 8,668,503 B2
(45) Date of Patent: Mar. 11, 2014

(54) FLEX TO FLEX CONNECTION DEVICE

(71) Applicant: Hi Rel Connectors, Inc, Claremont, CA (US)

(72) Inventors: Willis Williams, Claremont, CA (US); Derick Esquivel, Claremont, CA (US)

( * ) Notice: Subject to any disclaimer, the term of this patent is extended or adjusted under 35 U.S.C. 154(b) by 0 days.

(21) Appl. No.: 13/961,591

(22) Filed: Aug. 7, 2013

(65) Prior Publication Data

US 2013/0323945 A1 Dec. 5, 2013

Related U.S. Application Data

(63) Continuation of application No. 13/398,624, filed on Feb. 16, 2012, now Pat. No. 8,529,277.

(60) Provisional application No. 61/444,681, filed on Feb. 18, 2011, provisional application No. 61/450,076, filed on Mar. 7, 2011.

(51) Int. Cl.
*H01R 12/00* (2006.01)

(52) U.S. Cl.
USPC ..... 439/75; 439/369; 439/498; 439/655

(58) Field of Classification Search
USPC ..... 439/67, 74, 75, 492, 493, 494, 495, 439/498, 329, 499
See application file for complete search history.

(56) References Cited

U.S. PATENT DOCUMENTS 3,189,863 A * 6/1965 Leach ..... 439/418
3,613,049 A * 10/1971 Niedzwiecki ..... 439/329
3,701,964 A * 10/1972 Cronin ..... 439/45
3,721,940 A * 3/1973 Michel et al. ..... 439/495
3,796,986 A * 3/1974 Tamburro ..... 439/329
4,012,093 A * 3/1977 Crane ..... 439/67
4,125,310 A * 11/1978 Reardon et al. ..... 439/329
4,184,729 A * 1/1980 Parks et al. ..... 439/66
4,453,795 A * 6/1984 Moulin ..... 439/361
4,526,432 A * 7/1985 Cronin et al. ..... 439/320
4,538,865 A * 9/1985 Wakabayashi et al. ..... 439/66
4,647,125 A * 3/1987 Landi et al. ..... 439/67
4,808,112 A * 2/1989 Wood et al. ..... 439/66
4,828,512 A * 5/1989 McCormick et al. ..... 439/495
RE33,170 E * 2/1990 Byers ..... 607/57
4,913,656 A * 4/1990 Gordon et al. ..... 439/67
4,975,068 A * 12/1990 Squires ..... 439/67
5,071,357 A * 12/1991 Van Brunt et al. ..... 439/67
5,160,269 A * 11/1992 Fox et al. ..... 439/67
5,219,293 A * 6/1993 Imamura ..... 439/67
5,356,308 A * 10/1994 Toba et al. ..... 439/495

(Continued)

*Primary Examiner* — Ross Gushi
(74) *Attorney, Agent, or Firm* — Cotman IP Law Group, PLC

(57) ABSTRACT

A mechanical device for electrically connecting a first flexible assembly to a second flexible assembly comprises a wafer and a housing. The wafer has an insulator core and a plurality of wafer electrical connectors. The core has a first base side and an opposed second base side. The wafer electrical connectors include a first set of wafer electrical connector contacts exposed on the first base side and a second set of wafer electrical connector contacts exposed on the second base side. The wafer electrical connector contacts are adapted to electrically connect with each of the flexible assembly electrical contacts. The housing retains the wafer, the first flexible assembly terminal, and the second flexible assembly terminal in such a way that each of the first flexible assembly electrical contacts is removably secured and electrically connected to one of the wafer electrical connector contacts.

19 Claims, 4 Drawing Sheets

(56) References Cited

U.S. PATENT DOCUMENTS

| | | | | | |
|---|---|---|---|---|---|
| 5,482,473 | A * | 1/1996 | Lord et al. | 439/67 |
| 5,484,295 | A * | 1/1996 | Mowry et al. | 439/66 |
| 5,501,610 | A * | 3/1996 | Ikemoto | 439/498 |
| 5,632,638 | A * | 5/1997 | Matsushita et al. | 439/260 |
| 5,782,645 | A * | 7/1998 | Stobie et al. | 439/289 |
| 5,924,875 | A * | 7/1999 | Tighe et al. | 439/74 |
| 5,947,750 | A * | 9/1999 | Alcoe et al. | 439/67 |
| 5,993,247 | A * | 11/1999 | Kidd | 439/495 |
| 6,017,222 | A * | 1/2000 | Kao | 439/67 |
| 6,017,244 | A * | 1/2000 | Daane | 439/495 |
| 6,027,345 | A * | 2/2000 | McHugh et al. | 439/66 |
| 6,045,396 | A * | 4/2000 | Tighe | 439/493 |
| 6,077,090 | A * | 6/2000 | Campbell et al. | 439/67 |
| 6,165,009 | A * | 12/2000 | Anbo et al. | 439/498 |
| 6,220,881 | B1 * | 4/2001 | Murakami et al. | 439/262 |
| 6,226,862 | B1 * | 5/2001 | Neuman | 29/830 |
| 6,230,397 | B1 * | 5/2001 | Tighe | 29/830 |
| 6,247,951 | B1 * | 6/2001 | Di Liello et al. | 439/329 |
| 6,250,966 | B1 * | 6/2001 | Hashimoto et al. | 439/631 |
| 6,299,469 | B1 * | 10/2001 | Glovatsky et al. | 439/329 |
| 6,383,004 | B1 * | 5/2002 | Gunay et al. | 439/329 |
| 6,425,768 | B1 * | 7/2002 | Taylor | 439/67 |
| 6,431,876 | B1 * | 8/2002 | Svenkeson et al. | 439/67 |
| 6,468,106 | B2 * | 10/2002 | Durocher | 439/493 |
| 6,520,779 | B1 * | 2/2003 | Watanabe et al. | 439/66 |
| 6,722,915 | B1 * | 4/2004 | McAlonis et al. | 439/498 |
| 6,753,477 | B1 * | 6/2004 | Sinkunas et al. | 174/117 FF |
| 6,817,870 | B1 * | 11/2004 | Kwong et al. | 439/74 |
| 7,033,208 | B1 * | 4/2006 | Huang et al. | 439/498 |
| 7,131,861 | B2 * | 11/2006 | Aeschbacher | 439/495 |
| 7,223,105 | B2 * | 5/2007 | Weiss et al. | 439/66 |
| 7,341,476 | B2 * | 3/2008 | Soeta | 439/493 |
| 7,462,035 | B2 * | 12/2008 | Lee et al. | 439/37 |
| 7,731,517 | B2 * | 6/2010 | Lee et al. | 439/271 |
| 7,878,859 | B2 * | 2/2011 | Zhu | 439/638 |
| 8,251,712 | B2 * | 8/2012 | Cheng | 439/67 |
| 8,529,276 | B2 * | 9/2013 | Esquivel et al. | 439/67 |
| 8,529,277 | B2 * | 9/2013 | Williams et al. | 439/75 |
| 2005/0266725 | A1 * | 12/2005 | Pabst | 439/494 |
| 2007/0184682 | A1 * | 8/2007 | Gobron | 439/67 |
| 2009/0149036 | A1 * | 6/2009 | Lee et al. | 439/37 |
| 2009/0149037 | A1 * | 6/2009 | Lee et al. | 439/37 |
| 2012/0315773 | A1 * | 12/2012 | Esquivel et al. | 439/67 |
| 2012/0315774 | A1 * | 12/2012 | Williams et al. | 439/68 |

* cited by examiner

FLEX TO FLEX CONNECTION DEVICE

CROSS-REFERENCE TO RELATED APPLICATIONS

This application is a continuation of U.S. application Ser. No. 13/398,624, filed on Feb. 16, 2012; which claims priority from U.S. Provisional Patent Application Ser. No. 61/444,681, filed Feb. 18, 2011, and claims priority from U.S. Provisional Patent Application Ser. No. 61/450,076, filed Mar. 7, 2011, specifications of which are herein incorporated by reference in their entirety.

FIELD OF THE INVENTION

The invention relates generally to electrical connection assemblies and, more particularly, to connection assemblies comprising a pair of flexible electrical conductors.

BACKGROUND OF THE INVENTION

Sophisticated electrical and electronic components are frequently disposed proximate to high vibration equipment, such as aircraft and rocket engines. Because of the narrow confines wherein such components are typically disposed, interconnecting such components often employs the use of flexible electrical conductors ("flexible assemblies").

The prior art methods of attaching a flexible assembly to another flexible assembly usually employ some form of permanent attachment, such as methods wherein the flexible assemblies are soldered to one another.

Problems arise in such prior art methods when the attachment between the two flexible assemblies fails. Such failures cannot easily (if at all) be repaired in the field, and, in most cases, require the complete replacement of both flexible assemblies. Such complete replacement of both assemblies can be awkward, time-consuming and expensive.

Accordingly, there is a need for a method of attaching a flexible assembly to another flexible assembly which does not involve the aforementioned problems in the prior art.

SUMMARY OF THE INVENTION

The invention satisfies this need. The invention is a mechanical device for electrically connecting a first flexible assembly to a second flexible assembly, wherein the first flexible assembly comprises a first flexible assembly terminal end having a plurality of first flexible assembly electrical contacts and the second flexible assembly comprises a second flexible assembly terminal end having a plurality of second flexible assembly electrical contacts, the invention comprising (a) a wafer comprising an insulator core and a plurality of wafer electrical connectors, the core having a first base side and an opposed second base side, the wafer electrical connectors comprising a first set of wafer electrical connector contacts exposed on the first base side and a second set of wafer electrical connector contacts exposed on the second base side, each electrical contact in the first set of wafer electrical connector contacts being electrically connected to a corresponding electrical contact in the second set of wafer electrical connector contacts, each wafer electrical connector contact being sized and dimensioned to electrically connect with a first flexible assembly electrical contact or a second flexible assembly electrical contact, and (b) a housing for accepting and retaining (i) the wafer, (ii) the first flexible assembly terminal end disposed adjacent to the first base side of the wafer, and (iii) the second flexible assembly terminal end disposed adjacent to the second base side of the wafer, such that each of the first flexible assembly electrical contacts is removably secured and electrically connected to the first set of wafer electrical connector contacts and each of the second flexible assembly electrical contacts is removably secured and electrically connected to the second set of wafer electrical connector contacts.

DETAILED DESCRIPTION OF THE INVENTION

Figure 1:
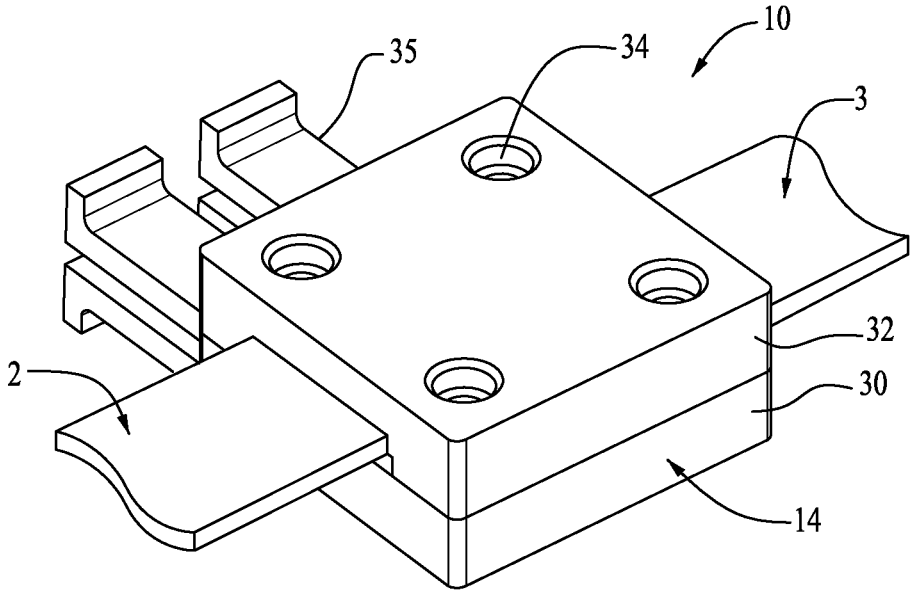
FIG. 1 is a perspective view of a mechanical device of the invention.
Figure 5:
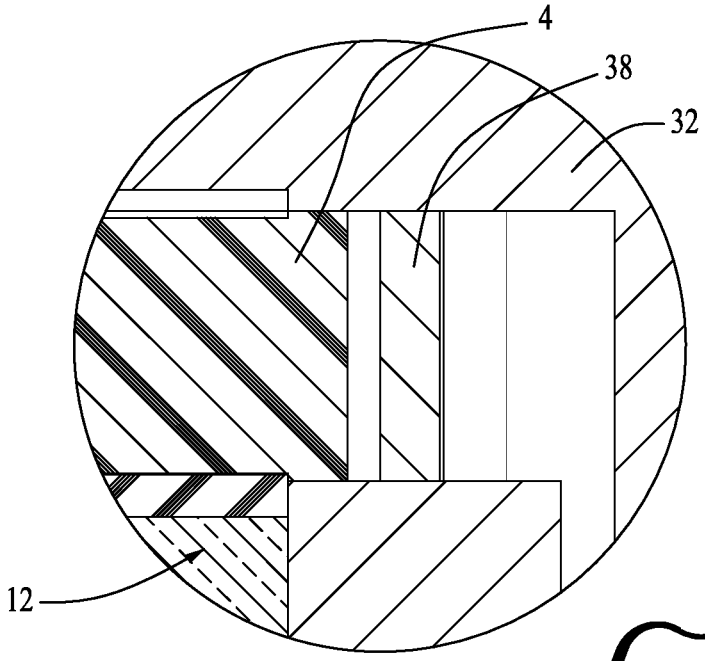
FIG. 5 is a detail view of a portion of the mechanical device illustrated in FIG. 4.
Figure 2:
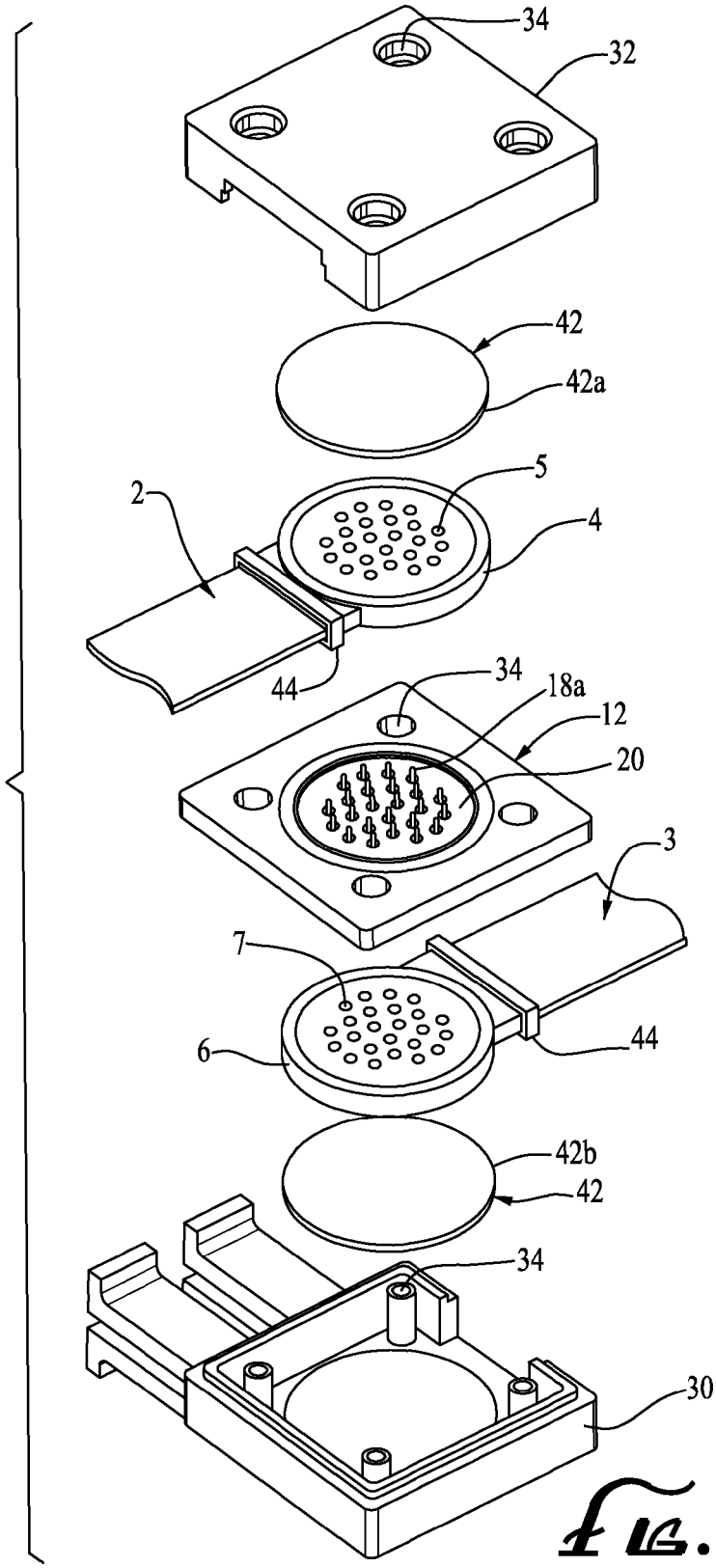
FIG. 2 is an exploded view of the mechanical device illustrated in FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a mechanical device 10 for electrically connecting a first flexible assembly 2 to a second flexible assembly 3. The first flexible assembly comprises a first flexible assembly terminal end 4 having a plurality of first flexible assembly electrical contacts 5, and the second flexible assembly comprises a second flexible assembly terminal end 6 having a plurality of second flexible assembly electrical contacts 7. The invention comprises a wafer 12 and a housing 14.

The wafer 12 is responsible for passing electrical signals and/or power distribution from one flexible assembly to the other.

The wafer 12 comprises an insulator core 16 and a plurality of wafer electrical connector contacts 18. The insulator core 16 can be a hermetic glass insulator 36.

The wafer electrical connector contacts 18 comprise a first set of wafer electrical connector contacts 18*a* exposed on a first base side 20 of the wafer 12 and a second set of wafer electrical connector contacts 18*b* exposed on a second base side 22 of the wafer 12. Each electrical contact 18 in the first set of wafer electrical connector contacts 18*a* is electrically connected to a corresponding electrical contact 18 in the second set of wafer electrical connector contacts 18*b*. Each wafer electrical contact 18 is sized and dimensioned to electrically connect with a first flexible assembly electrical contact 5 or a second flexible assembly electrical contact 7.

The contacts 5, 7 and 18 are reversible, in that they are readily replaceable and can be readily disengaged and reengaged without tools. The contacts 5, 7 and 18 are typically either double-ended pins 24 or double-ended sockets 26. The wafer 12 can have pin and/or socket electrical connector contacts of varying sizes.

The wafer electrical connector contacts 18 are typically spaced apart across the wafer 12. The wafer 12 can have dissimilar contact patterns on opposed sides of the wafer 12. The wafer 12 can be configured in various contact densities and patterns.

The wafer 12 can also comprise EMI/EMC bonding mechanisms and can include environment sealing features.

The wafer 12 can be constructed to be an active device, such as a device capable of acting as a transducer, Diode, capacitor or other electronic component, by attaching or embedding circuitry and/or electrical components therein.

The wafer 12 can be manufactured from various materials and can employ various dielectric materials.

The housing 14 is sized and dimensioned to accept and retain the wafer 12, the first flexible assembly 2 and the second flexible assembly 3. The first flexible assembly terminal end 4 is disposed adjacent to the first base side 20 of the wafer 12 and the second flexible assembly terminal end 6 is disposed adjacent to the second base side 22 of the wafer 12, such that each of the first flexible assembly electrical contacts 5 is removably secured and electrically connected to the first set of wafer electrical contacts 18*a* and each of the second flexible assembly electrical contacts 7 is removably secured and electrically connected to the second set of wafer electrical contacts 18*b*.

The housing 14 incorporates multiple entry and exit locations 28 for the flexible assemblies 2 and 3.

The housing 14 is typically stackable and comprises a base 30 and a top cover 32. The top cover 32 is secured to the base 30 by reversible fasteners. In the embodiment illustrated in the drawings, bores 34 are provided at each corner of the housing 14 to facilitate securing of the top cover 32 and the base 30 by bolts. Alternatively, the top cover 32 and the base 30 can be secured by nut and bolt pairs, clips, clamps or other equivalent reversible fasteners. Typically, the base 30 and the top cover 32 are made of interlocking construction for EMI and fire protection.

In the embodiment illustrated in the drawings, the housing 14 further comprises installation brackets 35.

The housing 14 can be made from a multitude of materials, including, but not limited to, aluminum, titanium, steel, plastic, PEEK and many different composite materials.

The housing 14 can be adapted to accommodate flexible assemblies having any shaped terminal end.

The housing 14 can also serve as an enclosure for various additional accessories, such as a mounting device.

The device 10 of the invention also typically comprises a double-ended grounding pad 38 and an interfacial seal 40.

The device 10 of the invention can also comprise gaskets 42 and/or grommets 44 to serve an array of functions, such as environmental sealing, EMI bonding, EMC bonding, vibration dampening and air volume reduction. The gaskets 42 can serve as a first spacer 42*a* and a second spacer 42*b*. The first spacer 42*a* is disposed between the housing 14 and the first flexible assembly 2 and the second spacer 42*b* is disposed between the housing 14 and the second flexible assembly 3.

Figure 3:
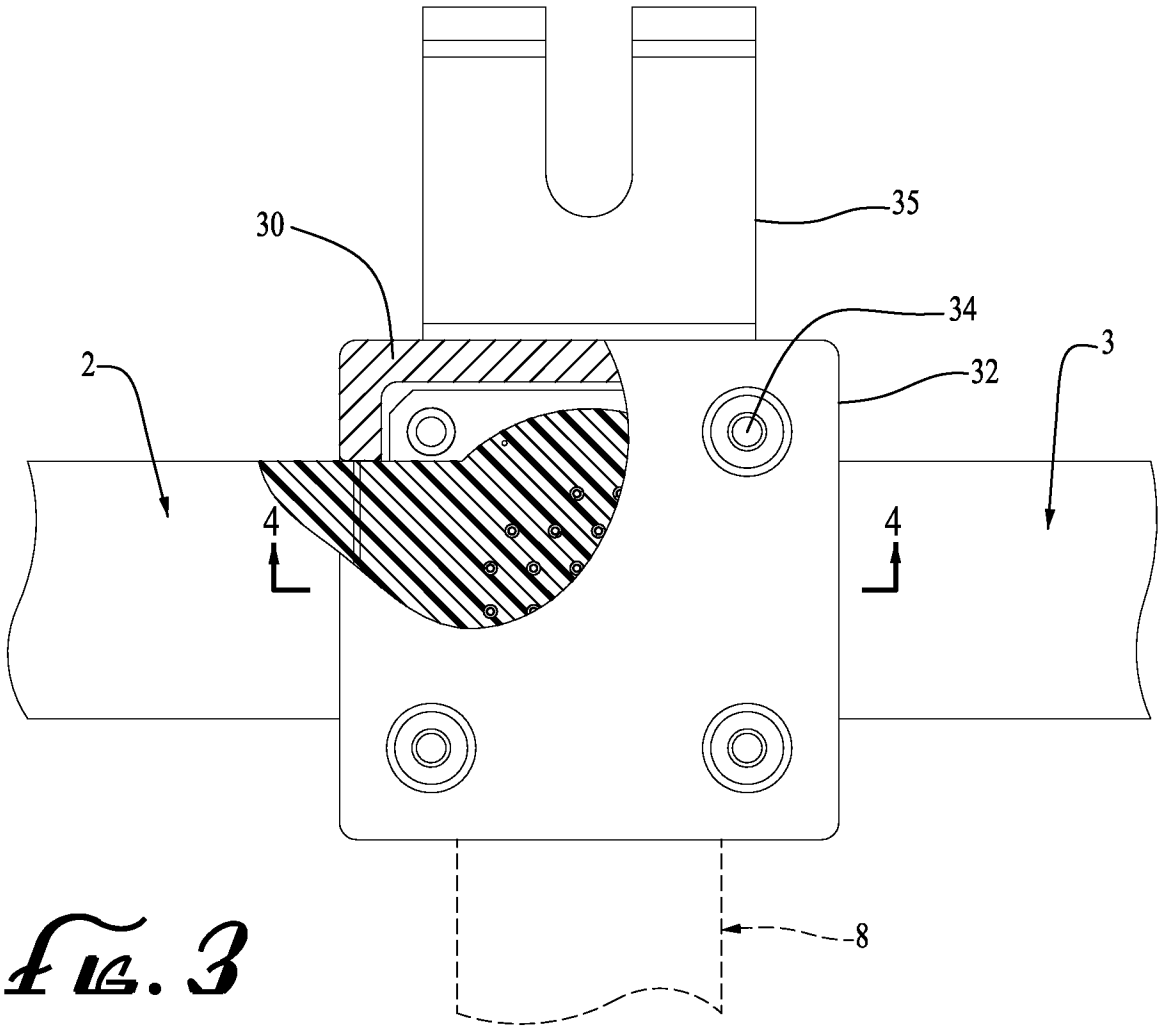
FIG. 3 is a top view in partial cross-section of the mechanical device illustrated in FIG. 1.
Figure 4:
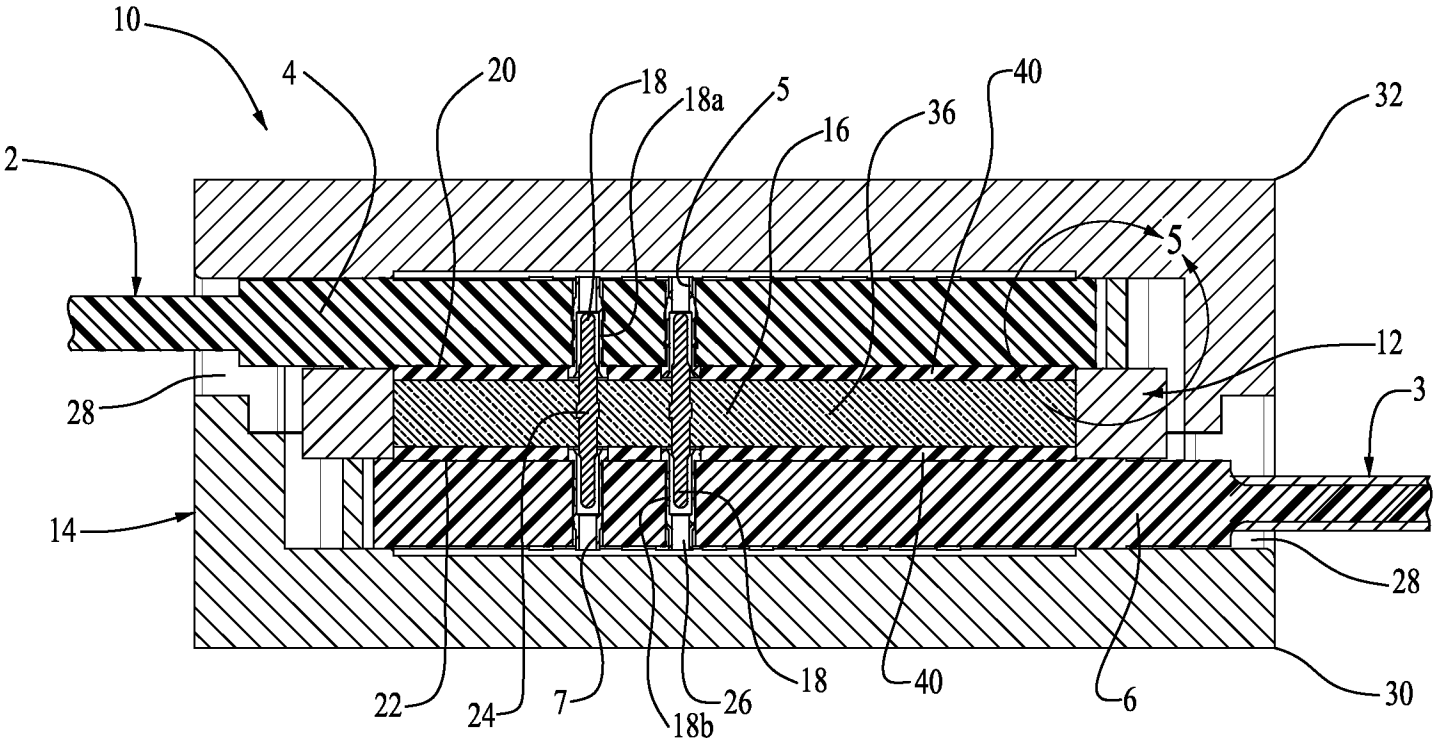
FIG. 4 is a cross-sectional side view of the mechanical device illustrated in FIG. 1.

It should be noted that the device can be adapted to electrically connect more than two flexible assemblies. For example, FIG. 3 illustrates the electrical connection of a first flexible assembly 2, a second flexible assembly 3 and a third flexible assembly 8.

The device 10 of the invention employs no solder or other permanent, nonreversible connections with the terminal ends of the flexible assemblies 2 and 3.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A connector assembly for flex to flex connection comprising:

a housing configured for electrically coupling a plurality of terminal ends of flexible assemblies, each one of said plurality of terminal ends of flexible assemblies comprising a plurality of terminal end electrical contacts; and a wafer with a first base side and an opposed second base side, said wafer comprising an insulator core with a plurality of wafer electrical connector contacts configured to electrically couple a first one of said plurality of terminal ends of said flexible assemblies at said first base side to a second one of said plurality of terminal ends of said flexible assemblies at said second base side, wherein each of said plurality of wafer electrical connector contacts comprises a first plurality of wafer electrical connector contacts exposed on said first base side and a second plurality of wafer electrical connector contacts exposed on said second base side, wherein each one of said first plurality of wafer electrical connector contacts is electrically coupled to a corresponding one of said second plurality wafer electrical connector contacts, wherein said wafer further comprises an interfacial seal and a circumferential double ended grounding pad on each of said first base side and said second base side.

2. The connector assembly of claim 1, further comprising one or more gaskets configured to be placed between an inside wall of said housing and a terminal end of a flexible assembly.

3. The connector assembly of claim 1, wherein said plurality of wafer electrical connector contacts comprises pins.

4. The connector assembly of claim 1, wherein each one of said plurality of terminal end electrical contacts is a socket and a corresponding one of said plurality of wafer electrical connector contacts is a pin configured to tightly couple with said socket.

5. The connector assembly of claim 1, wherein each one of said plurality of wafer electrical connector contacts is replaceable.

6. The connector assembly of claim 1, wherein said housing comprises a top cover and a bottom cover, said top cover configured to be secured to said bottom cover using reversible fasteners.

7. The connector assembly of claim 1, wherein said insulator core comprises hermetic glass.

8. The connector assembly of claim 1, wherein said plurality of terminal ends of flexible assemblies comprises a terminal end of a first flexible assembly and a terminal end of a second flexible assembly.

9. The connector assembly of claim 1, wherein a first one of said wafer is configured to be placed between a first one of said plurality of terminal ends of flexible assemblies and a second one of said plurality of terminal ends of flexible assemblies, and a second one of said wafer is configured to be placed between said second one of said plurality of terminal ends of flexible assemblies and a third one of said plurality of terminal ends of flexible assemblies.

10. A connector assembly for connecting flexible assemblies comprising:

a housing configured for coupling a plurality of terminal ends of flexible assemblies in a stackable configuration, wherein each one of said plurality of terminal ends of flexible assemblies comprising a plurality of terminal end electrical contacts; and at least one wafer, each of said wafer configured to be located between each pair of said plurality of terminal ends of flexible assemblies, said wafer comprising:

a first base side and an opposed second base side;

an insulator core with a plurality of wafer electrical connector contacts configured to electrically couple a first one of said plurality of terminal ends of said flexible assemblies at said first base side to a second one of said plurality of terminal ends of said flexible assemblies at said second base side, wherein each of said plurality of wafer electrical connector contacts comprises a first plurality of wafer electrical connector contacts exposed on said first base side and a second plurality of wafer electrical connector contacts exposed on said second base side, wherein each one of said first plurality of wafer electrical connector contacts is electrically coupled to a corresponding one of said second plurality wafer electrical connector contacts;

an interfacial seal on each of said first base side and said second base side; and a circumferential double ended grounding pad on each of said first base side and said second base side.

11. The connector assembly of claim 10, further comprising one or more gaskets configured to be placed between an inside wall of said housing and a terminal end of a flexible assembly.

12. The connector assembly of claim 10, wherein a terminal end electrical contact of said plurality of terminal end electrical contacts is a socket when a corresponding one of said plurality of wafer electrical connector contacts is a pin, and said terminal end of said plurality of terminal end electrical contacts is a pin when said corresponding one of said plurality of wafer electrical connector contacts is a socket.

13. The connector assembly of claim 10, wherein each one of said plurality of terminal end electrical contacts is a socket and a corresponding one of said plurality of wafer electrical connector contacts is a pin configured to tightly couple with said socket.

14. The connector assembly of claim 10, wherein each one of said plurality of wafer electrical connector contacts is replaceable.

15. The connector assembly of claim 10, wherein said housing comprises a top cover and a bottom cover, said top cover configured to be secured to said bottom cover using reversible fasteners.

16. A connector assembly for connecting flexible assemblies comprising:

a housing configured for coupling a plurality of terminal ends of flexible assemblies in a stackable configuration, wherein each one of said plurality of terminal ends of flexible assemblies comprising a plurality of terminal end electrical contacts; and at least one wafer, each of said wafer configured to be located between each pair of said plurality of terminal ends of flexible assemblies, said wafer comprising:

a first base side and an opposed second base side; and an insulator core with a plurality of wafer electrical connector contacts configured to electrically couple a first one of said plurality of terminal ends of said flexible assemblies at said first base side to a second one of said plurality of terminal ends of said flexible assemblies at said second base side, wherein one or more of said plurality of wafer electrical connector contacts comprises a pin with a first exposed end at said first base side and a second exposed end at said second base side, wherein said first exposed end of said pin is configured to mechanically and electrically couple to a corresponding one of said plurality of terminal end electrical contacts at said first base side and said second exposed end of said pin is configured to mechanically and electrically couple to a corresponding one of said plurality of terminal end electrical contacts at said second base side, wherein said insulator core comprises hermetic glass.

17. The connector assembly of claim 16, further comprising one or more gaskets configured to be placed between an inside wall of said housing and a terminal end of a flexible assembly.

18. The connector assembly of claim 16, wherein a terminal end electrical contact of said plurality of terminal end electrical contacts is a socket when a corresponding one of said plurality of wafer electrical connector contacts is a pin, and said terminal end of said plurality of terminal end electrical contacts is a pin when said corresponding one of said plurality of wafer electrical connector contacts is a socket.

19. The connector assembly of claim 16, wherein said housing comprises a top cover and a bottom cover, said top cover configured to be secured to said bottom cover using reversible fasteners.

* * * * *